US012390002B1

(12) United States Patent
Sullivan

(10) Patent No.: US 12,390,002 B1
(45) Date of Patent: Aug. 19, 2025

(54) SINK FOR CLEANING PAINT BRUSHES AND ROLLER COVERS

(71) Applicant: Christian Sullivan, Petaluma, CA (US)

(72) Inventor: Christian Sullivan, Petaluma, CA (US)

( * ) Notice: Subject to any disclaimer, the term of this patent is extended or adjusted under 35 U.S.C. 154(b) by 0 days.

(21) Appl. No.: 19/075,264

(22) Filed: Mar. 10, 2025

(51) Int. Cl.
*A46B 17/06* (2006.01)
*E03C 1/18* (2006.01)

(52) U.S. Cl.
CPC ..... *A46B 17/06* (2013.01); *E03C 1/18* (2013.01)

(58) Field of Classification Search
CPC ..... A46B 13/001; A46B 13/02; A46B 13/04; A46B 15/0055; A46B 17/06; A47J 74/20; B08B 3/006; E03C 1/186
USPC ..... 4/628, 629, 630, 631; 15/320
See application file for complete search history.

(56) References Cited

U.S. PATENT DOCUMENTS 6,588,030 B1 * 7/2003 Wulff ..... A47K 3/281 D6/532
11,781,302 B2 * 10/2023 Grybush ..... A47B 77/06 4/619
2009/0139023 A1 * 6/2009 Talerico ..... E03C 1/186 4/654

FOREIGN PATENT DOCUMENTS

CN 116556479 A * 8/2023

* cited by examiner

*Primary Examiner* — Brian D Keller
*Assistant Examiner* — Aaron R McConnell
(74) *Attorney, Agent, or Firm* — My Patent Guys; Christopher Pilling; Colton Bangs

(57) ABSTRACT

A sink for cleaning paint brushes and roller covers saturated with water-based paints is provided. The sink contains a cleaning brush wheel in a sink basin rotationally driven by a motor to clean paint brushes. The sink further contains a hanger underneath an overhang portion of the sink basin to secure a paint roller on for cleaning with a jet of water. The overhang portion prevents paint-water effluent from spraying outside of the sink basin. The sink has one or more ports for connecting it to a water source. There is a drain in the bottom of the sink basin with an attached drain hose for collecting the paint-water effluent from the cleaning process in order to dispose of it properly.

9 Claims, 8 Drawing Sheets

SINK FOR CLEANING PAINT BRUSHES AND ROLLER COVERS

CROSS-REFERENCE TO RELATED APPLICATIONS

N/A

BACKGROUND OF THE INVENTION

1. Field of the Invention

The present invention generally relates to cleaning painting equipment, but more particularly to a sink for cleaning paint brushes and roller covers.

2. Description of Related Art

Brushes and roller covers with covers have been used for years in the painting industry, however, the cleaning of paint from them after use remains difficult and cumbersome. The inability to fully and properly clean brushes and roller covers leads to their premature deterioration. This means they have to be replaced more frequently leading to higher operating costs for painters and a higher environmental impact from landfilling and producing more brushes and roller covers.

The growing use of water-based paints has made cleaning more accessible as they can be removed with water instead of solvents such as turpentine which are needed to remove oil-based paints. This does not, however, mean that the cleaning of water-based paints from painting equipment is easy or is a problem that has been well-solved. Standard practices for cleaning paint brushes include rinsing under running water and sometimes scrubbing with a wire brush. This highly manual practice is ineffective and cumbersome, particularly for professional painters which may have a large number of brushes to clean at a time. The standard practice for cleaning paint roller covers is to spray them with a hose at an angle which creates enough force to make the roller spin and expel the paint from the roller cover using centrifugal force. The problem with this method is that it creates a large spray of paint-water, which can leave color and residue all over the cleaning area and on the individual.

The cleaning of brushes and roller covers in the painting industry may take place on the jobsite or back at the company shop, and it may take place indoors or outdoors. Hence, it would be preferable that a cleaning solution be portable and suitable for use in a range of conditions and environments.

Another important consideration is the paint-water effluent from the cleaning process, which can typically be treated in the municipal sewer system but is typically not allowed to enter stormwater systems nor septic systems, nor be directly discharged to the environment. A proper cleaning system for paint brushes and roller covers needs to be able to capture the paint-water effluent and drain it to the municipal sewer system or to an on-site treatment process.

The cleaning of paint brushes and roller covers today is a time-consuming and cumbersome process. Too many paint residues enter the environment and too much painting equipment has to be prematurely replaced due to inadequate cleaning. Consequently, a solution is needed.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

It is an object of the present invention to provide a sink for cleaning paint brushes.

It is another object of the present invention to provide a sink for cleaning paint roller covers.

In order to do so, an apparatus for cleaning painting equipment is provided, comprising a sink body containing a sink basin having a niche formed in a wall of the sink basin; a cleaning brush wheel positioned at least partially in the niche, the cleaning brush wheel extending into the sink basin; an axle running through the center of the cleaning brush wheel on a first end of the axle and connecting to a motor on a second end of the axle; a faucet mounted to the sink body so that the faucet directs water into the sink basin and onto the cleaning brush wheel; one or more water ports for connecting the faucet to a water source; the motor mounted on the sink body and capable of spinning the cleaning brush wheel via the axle; and a drain in the bottom of the sink basin connected to a drain hose.

In one embodiment, the sink body is constructed of injection-molded plastic. In another embodiment, the sink body is constructed of stainless steel. In one embodiment, the cleaning brush wheel comprises stainless-steel bristles. In one embodiment, the one or more ports includes a hot water port and a cold water port. In another embodiment, the one or more ports includes a port for attaching a hose. In one embodiment, the motor is a variable speed motor capable of driving the cleaning brush wheel at different speeds. In one embodiment, one or more legs attached to the sink body are provided to elevate the sink basin.

In another aspect of the invention, an apparatus for cleaning painting equipment is provided, comprising a sink body containing a sink basin; an overhang portion of the sink body which serves as a partial ceiling to the sink body, the overhang portion partially extending over at least a portion of the sink basin, wherein the overhang portion is configured to capture and direct overspray back into the sink basin; a hanger attached to the sink body and located underneath the overhang portion, the hanger dimensioned to support a paint roller so that a paint roller cover portion is positioned within the sink basin and under the overhang portion during cleaning; a securing element configured to secure the paint roller cover in place during cleaning; and a drain in the bottom of the sink basin connected to a drain hose.

In one embodiment, the overhang portion includes a slit enabling a neck of the paint roller to pass through such that the paint roller is configured to be positioned in a vertical orientation on the hanger. In one embodiment, the apparatus further comprises a hinged panel that is configured to close over the slit in the overhang portion to secure the paint roller in position during cleaning.

In yet another aspect of the invention, an apparatus for cleaning painting equipment is provided, comprising a sink body defining a sink basin with a niche formed in a sidewall of the sink basin; a cleaning brush wheel positioned at least partially in the niche, the brush wheel extending into the sink basin to receive water from a faucet; a motor mounted on the sink body and operably connected to the cleaning brush wheel via an axle; an overhang extending over at least a portion of the sink basin, the overhang configured to confine overspray and splatter within the sink basin; a hanger positioned beneath the overhang to support a paint roller cover in the sink basin and a slit to allow the paint roller to be positioned under the overhang during cleaning; one or more water ports connectable to a water source for supplying water to the faucet; and a drain in the bottom of the sink basin for channeling paint-water effluent away from the sink body.

In one embodiment, the faucet is centrally positioned within the sink basin and is configured to swivel between: a first position, in which the faucet directs water toward the center of the sink basin for conventional sink use, and a second position, in which the faucet is positioned over the cleaning brush wheel to direct water onto the bristles for cleaning paint brushes.

The foregoing has outlined rather broadly the more pertinent and important features of the present disclosure so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present disclosure. It should be realized by those skilled in the art that such equivalent structures do not depart from the spirit and scope of the invention as set forth in the appended claims.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF EMBODIMENTS OF THE INVENTION

Figure 1:
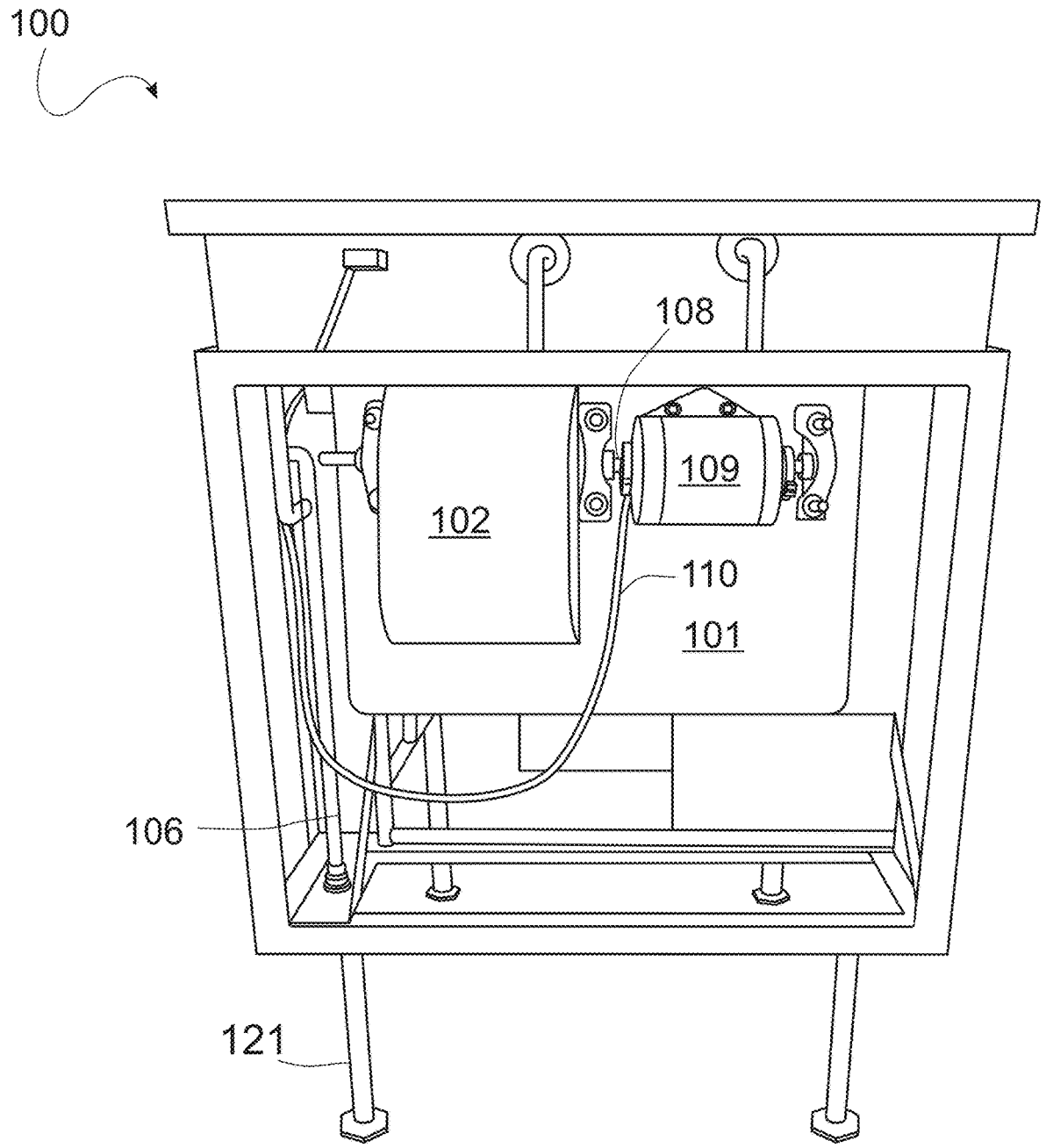
FIG. 1 is a back view of a sink for cleaning paint brushes and roller covers according to an embodiment of the present invention.
Figure 2:
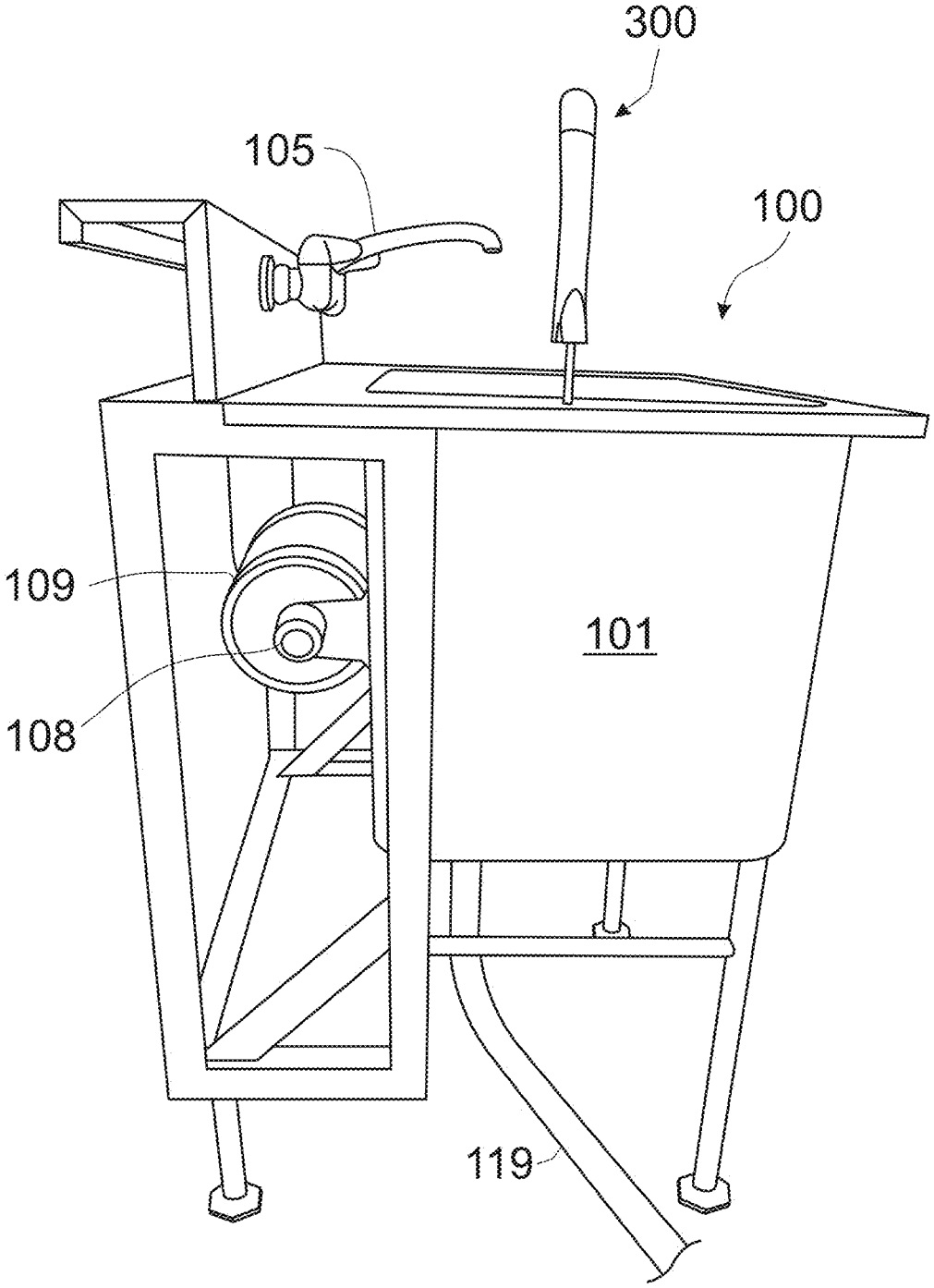
FIG. 2 is a left side view of a sink for cleaning paint brushes and roller covers according to an embodiment of the present invention.
Figure 3:
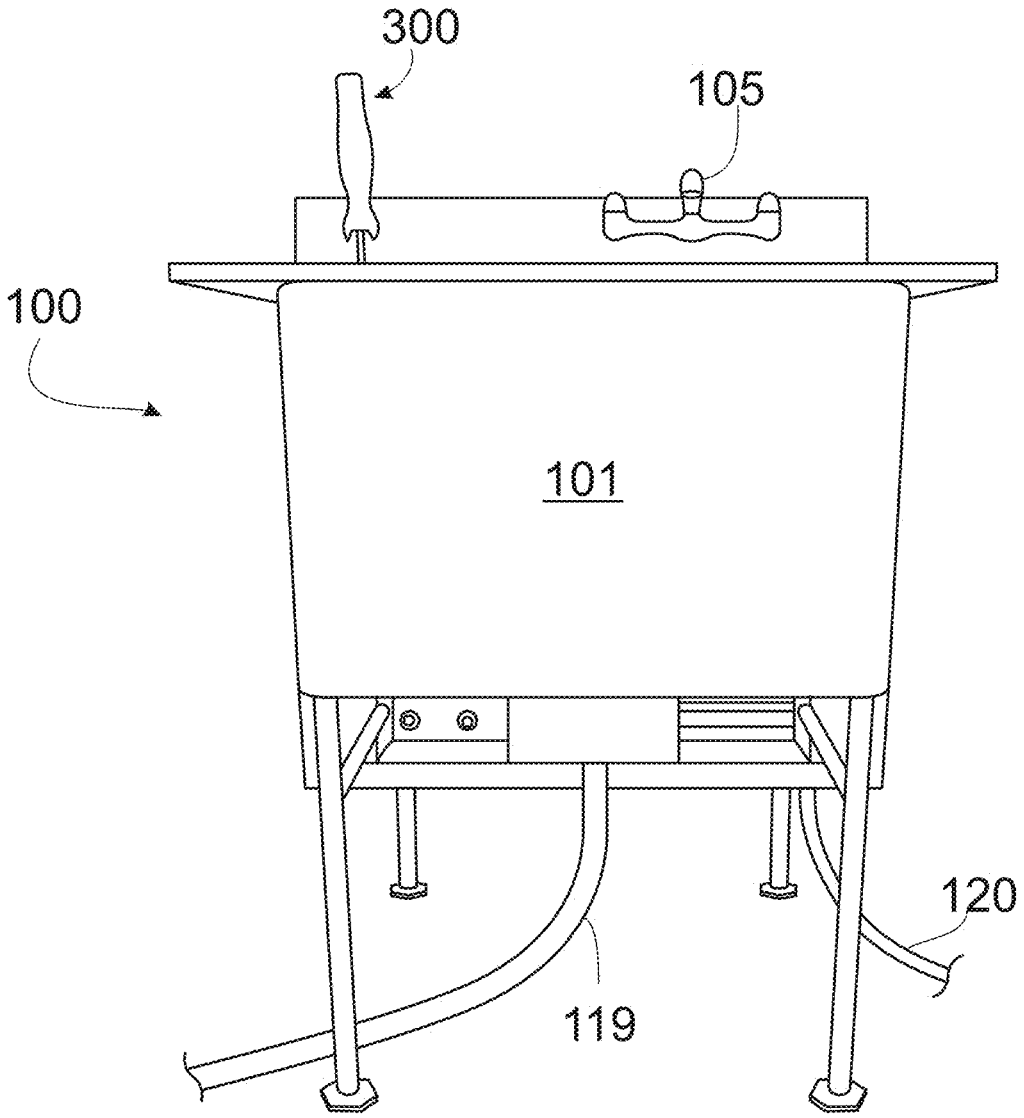
FIG. 3 is a front view of a sink for cleaning paint brushes and roller covers according to an embodiment of the present invention.
Figure 4:
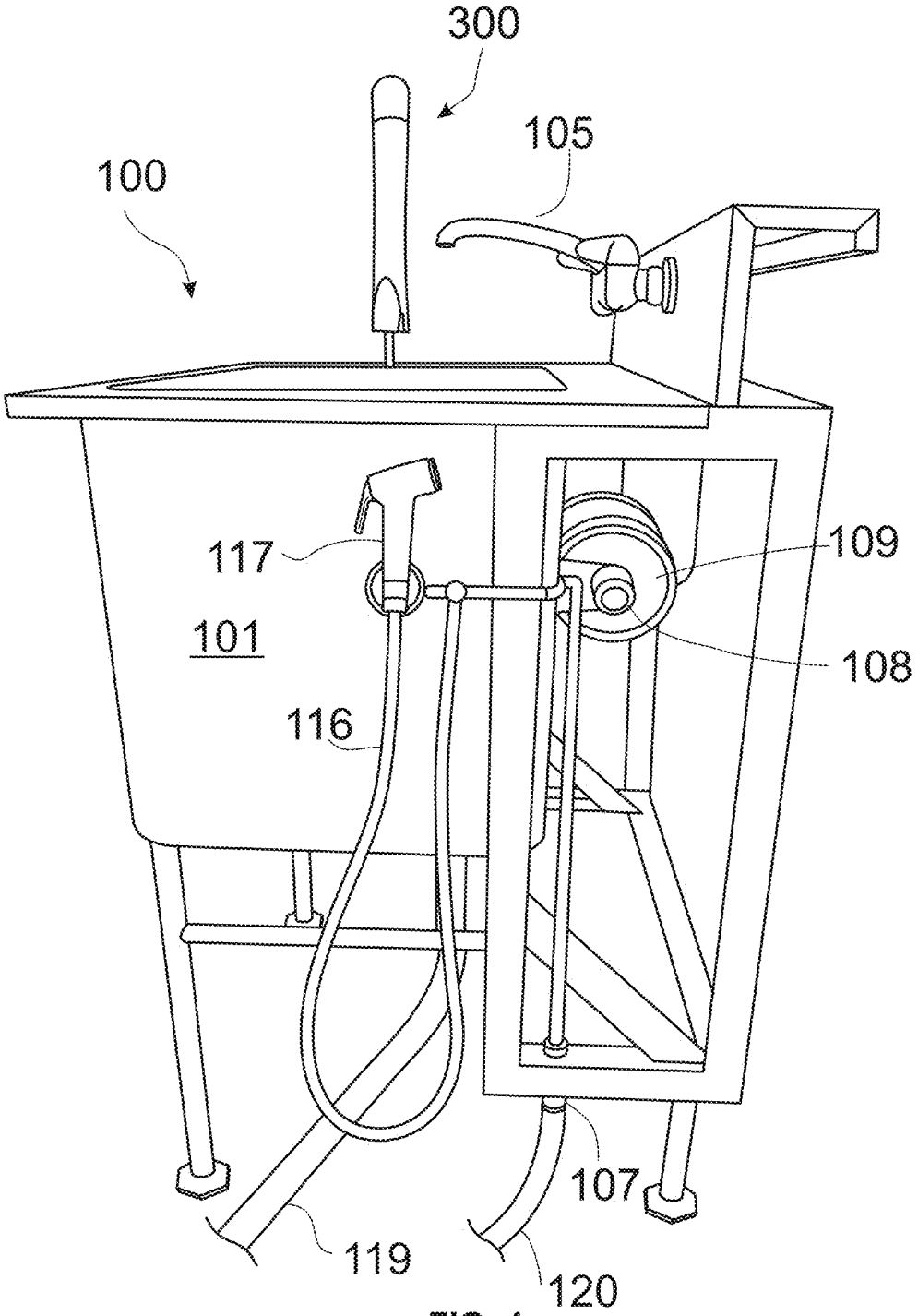
FIG. 4 is a right side view of a sink for cleaning paint brushes and roller covers, the niche removed for clarity to better illustrate other components, according to an embodiment of the present invention.

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein to specifically provide a sink for cleaning paint brushes and roller covers.

As used herein, the singular forms "a," "an," and "the" include plural references unless the context clearly dictates otherwise. Any reference to "or" herein is intended to encompass "and/or" unless otherwise stated. As used herein, the term "about" or "approximately" refers to an amount that is near the stated amount by about 0%, 5%, or 10%, including increments therein. Alternatively, the term "about" or "approximately" refers to a range of values within plus or minus 10% of the specified number. As used in this application, the term "substantially" means that the actual value is within about 10% of the actual desired value, particularly within about 5% of the actual desired value and especially within about 1% of the actual desired value of any variable, element or limit set forth herein. As used herein, the term "attached to" refers to direct attachment or attachment via one or more additional elements.

As used herein, the term "paint roller" generally refers to a painting tool having a handle (or frame) with a rotating cylindrical core or spindle. During operation, the cylindrical core is configured to rotate freely around the handle (or frame), allowing for efficient application of paint. As used herein, the term "paint roller cover" refers to a generally cylindrical sleeve or covering dimensioned to fit over the paint roller's cylindrical core. A paint roller cover is typically constructed of absorbent material (such as fabric or foam) and is configured to hold and distribute paint. As is well known in the art, once attached to the paint roller core, the paint roller cover enables the roller assembly to spin and apply paint to a surface.

Referring now to any of the accompanying FIGS. 1-7, the sink for cleaning paint brushes 200 and roller covers 301 is shown. The invention comprises a sink body 100 containing a sink basin 101. In some embodiments, the sink body 100 may be made of injection-molded plastic. In other embodiments, the sink body is constructed of metal, or any other suitable material, such as stainless steel. In one embodiment, the sink body 100 dimensions are approximately: 36" height by 24" depth by 30" width. In one embodiment, the sink basin 101 dimensions are approximately: 16" height by 16" depth by 18" width. In one embodiment, the sink body 100 is of a size and weight that enables it to be easily carried by one or two persons, loaded in and out of a truck or other vehicle, and hence to be used in a portable manner. In another embodiment, the sink is only used in a stationary setting in a workshop or garage. In some embodiments, the sink is supported by one or more legs 121.

Figure 5:
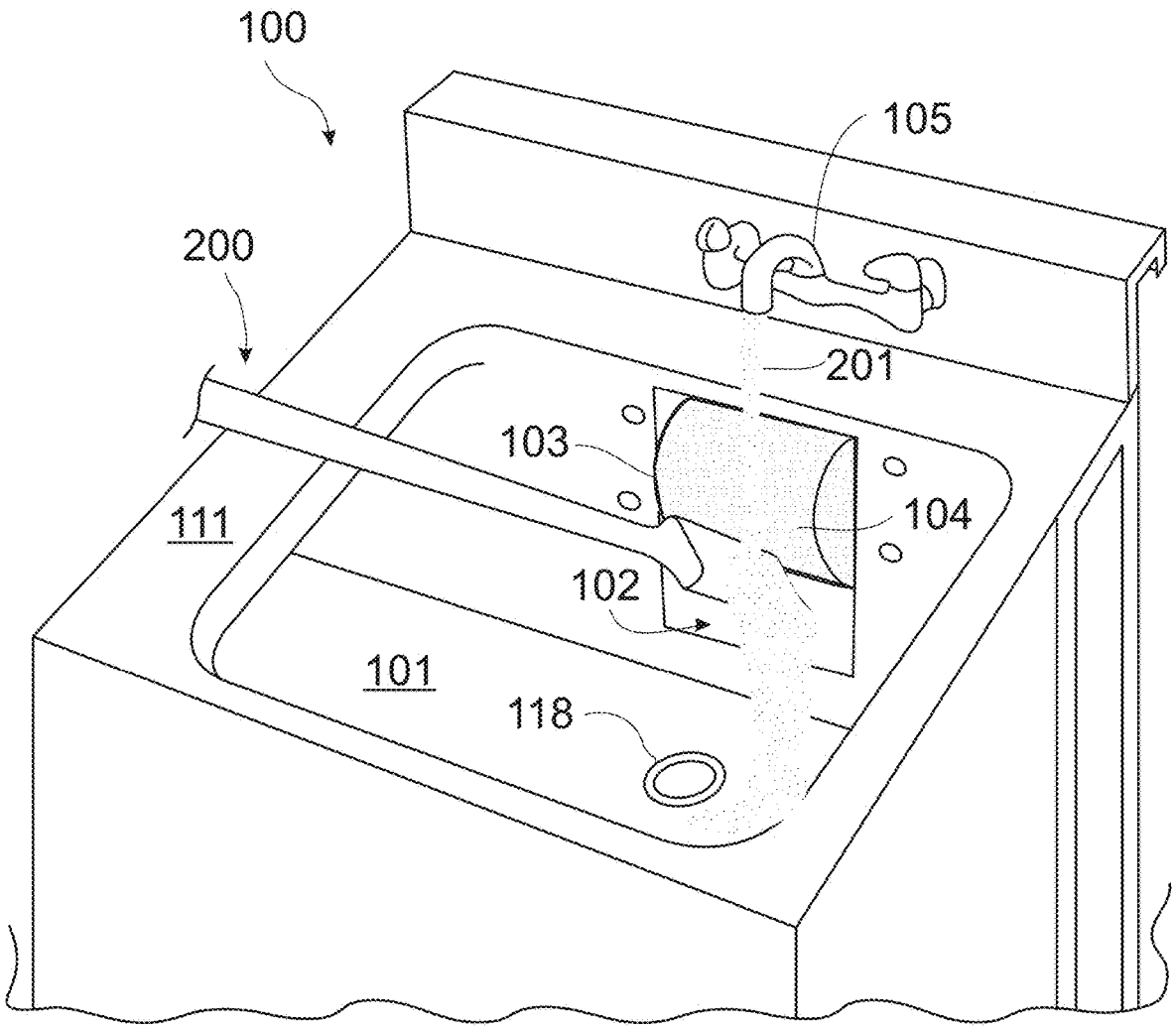
FIG. 5 is a detailed view of a sink basin of a sink for cleaning paint brushes and roller covers according to an embodiment of the present invention.

Best seen in FIG. 5, in some embodiments, within the sink basin 101 is a niche 102 where a cleaning brush wheel 103 is located. In one embodiment, the cleaning brush wheel 103 comprises stainless steel bristles 104. In some embodiments, the cleaning brush wheel 103 is substantially located within the niche 102. In one embodiment, the cleaning brush wheel 103 has a small portion extending out into the sink basin 101 where it receives running water 201 from a faucet 105 directly above it. The faucet 105 is fed water by one or more pipes 106, wherein the pipes 106 have ports 107 at their opposite end which are configured to connect to a water source 120. In one embodiment, there is a hot water pipe that connects to a hot water port and here is a cold water pipe that connects to a cold water port. In another embodiment, there is a single pipe that may be connected to a hose water port.

In some embodiments, the faucet 105 has a cold and hot water valve. Although not illustrated, in other embodiments, the faucet is a single lever faucet comprising a mixing valve. Those skilled in the art would appreciate that the goal is for the provided faucet 105 to be configured to connect to a water source, and the number of variations and configurations may vary depending on the installation location, and if used as a portable system or permanently installed in a workshop or garage.

Returning to the cleaning brush wheel 103, in one embodiment it is connected to an axle 108 which extends through a side wall of the sink niche 102 and ultimately connects to a motor 109. In one embodiment, the motor 109 is attached to the rear side of the sink body 100. The motor 109 is configured to drive the rotation of the axle 108 which in turn drives the rotation of the cleaning brush wheel 103. The motor 109 is configured to be operated by any well-known method to operate the motor, including but not limited to, switches, buttons, remotes, phone applications, etc. Further, the motor may be configured for single speed operation, or be configured to multiple or variable speeds controlled by a user.

During use, with the faucet 105 running water 201 onto the cleaning brush wheel 103, a paint brush 200 can then be pressed against the spinning brush wheel 103 at different orientations to fully remove the paint from the paint brush. As previously discussed, the motor 109 is configured to operate at variable speeds, enabling the cleaning brush wheel 103 to spin at different rates to accommodate different cleaning requirements. In one embodiment, the motor 109 has a power cable (not shown) to connect it to a power outlet. In another embodiment, the motor 109 is powered by a battery (not shown). In one embodiment, the motor 109 is configured to direct-drive the cleaning brush wheel 103. In another embodiment, the motor 109 is configured to drive the axle 108 via a pulley (not shown). In one embodiment, the motor 109 is an AC motor. In another embodiment, the motor 109 is a DC motor. In one embodiment, a cable 110 connects the motor 109 to a switch (not shown) located on the sink body 100, which enables the motor 109 and thus cleaning brush wheel 103 to be turned on and off in a convenient manner. In some embodiments, the motor is configured to be connected with a controller.

Figure 6:
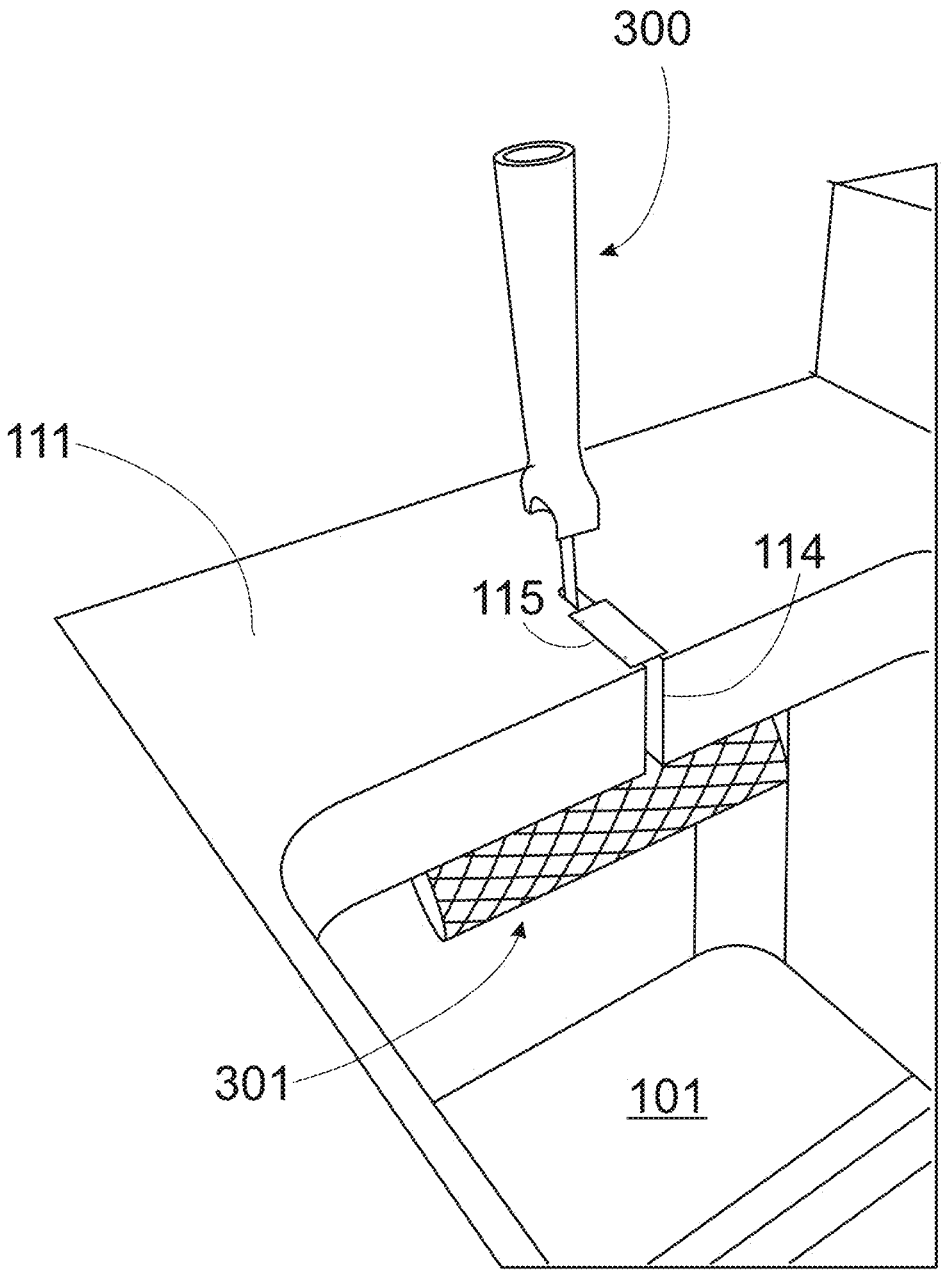
FIG. 6 is a detailed view of a sink basin of a sink for cleaning paint brushes and roller covers according to an embodiment of the present invention.
Figure 7:
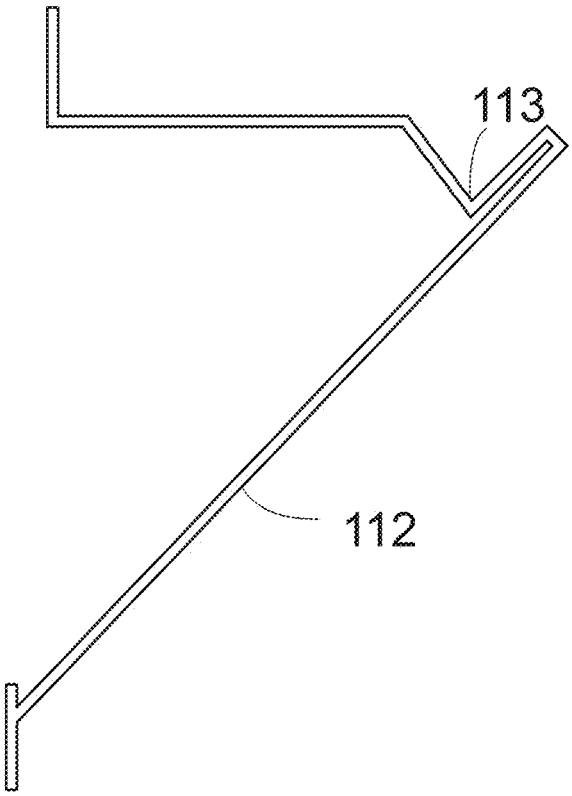
FIG. 7 is a profile view of a hanger for a paint roller of a sink for cleaning paint brushes and roller covers according to an embodiment of the present invention.

Now, the components and method for cleaning a paint roller cover 301 will be described. In one embodiment, the sink body 100 contains an integral overhang 111 which extends over the sink basin 101 to partially cover the sink basin 101. The overhang 111 provides a partial ceiling for the sink basin 101, under which the paint roller cleaning is executed. In one embodiment, the paint roller is placed on a hanger 112 (Best seen in FIG. 7) which is connected to the sink body 100 and located underneath the overhang 111. In one embodiment, the hanger is shaped according to the profile view shown in FIG. 7. In one embodiment, a horizontal segment of the neck of the paint roller rests on top of the hanger 112 in a valley 113 of the hanger 112. The paint roller cover, which is the part of the paint roller to be cleaned, hangs below the hanger 112 where it can be sprayed with a jet of water, via jet sprayer 117. In one embodiment, the jet of water is applied to the paint roller cover (301; FIG. 6) at an orientation that forces the paint roller cover to spin and expel the attached paint along with the water using centrifugal force. The overhang 111 prevents the radial spray of paint-water effluent from the paint roller cover 301 from exiting the sink basin 101 and helps direct the paint-water effluent down to the bottom of the sink basin 101, and towards the drain 118. In some embodiments, the handle and neck of the paint roller, which extend in an upwards direction from the hanger 112, are held in place which can be accomplished by a variety of means. In one embodiment, there is a long and narrow slit 114 in the overhang 111 through which the neck of the paint roller may pass enabling the paint roller to be placed in a vertical orientation on the hanger 112 with the handle of the paint roller located directly above the paint roller cover. In some embodiments, this orientation can be locked in place by blocking the return of the neck of the paint roller back out the slit 114 using a clasp, vise, clamp, fastener, or other like mechanism.

In one embodiment, the return of the paint roller back out of the slit 114 is achieved by a hinged panel 115 which runs approximately the entire length of the slit 114 to the point where the neck of the paint roller extends upwards through the overhang 111. The hinged panel 115 connects to the overhang 111 on one side of the slit 114. The hinged panel 115 is lifted into a vertical position to "unlock" the slit 114 and insert or remove a paint roller 300. The hinged panel 115 is lowered into a horizontal position in which it spans the length and width of the slit 114 to "lock" the slit 114 so that the paint roller is held in place during cleaning. An advantage of this embodiment is that the hinged panel 115 in the locked position blocks the paint-water effluent from the spinning paint roller cover from escaping the sink basin 101 through the slit 114.

In one embodiment, the jet of water for cleaning the paint roller is provided via a hose attachment 116 with a spray gun nozzle 117. In one embodiment, the hose attachment 116 is connected to a pipe 106 for its water source. In some embodiments, the spray gun nozzle may be supported by a holder affixed to an outer surface of the sink basin 101.

Figure 8:
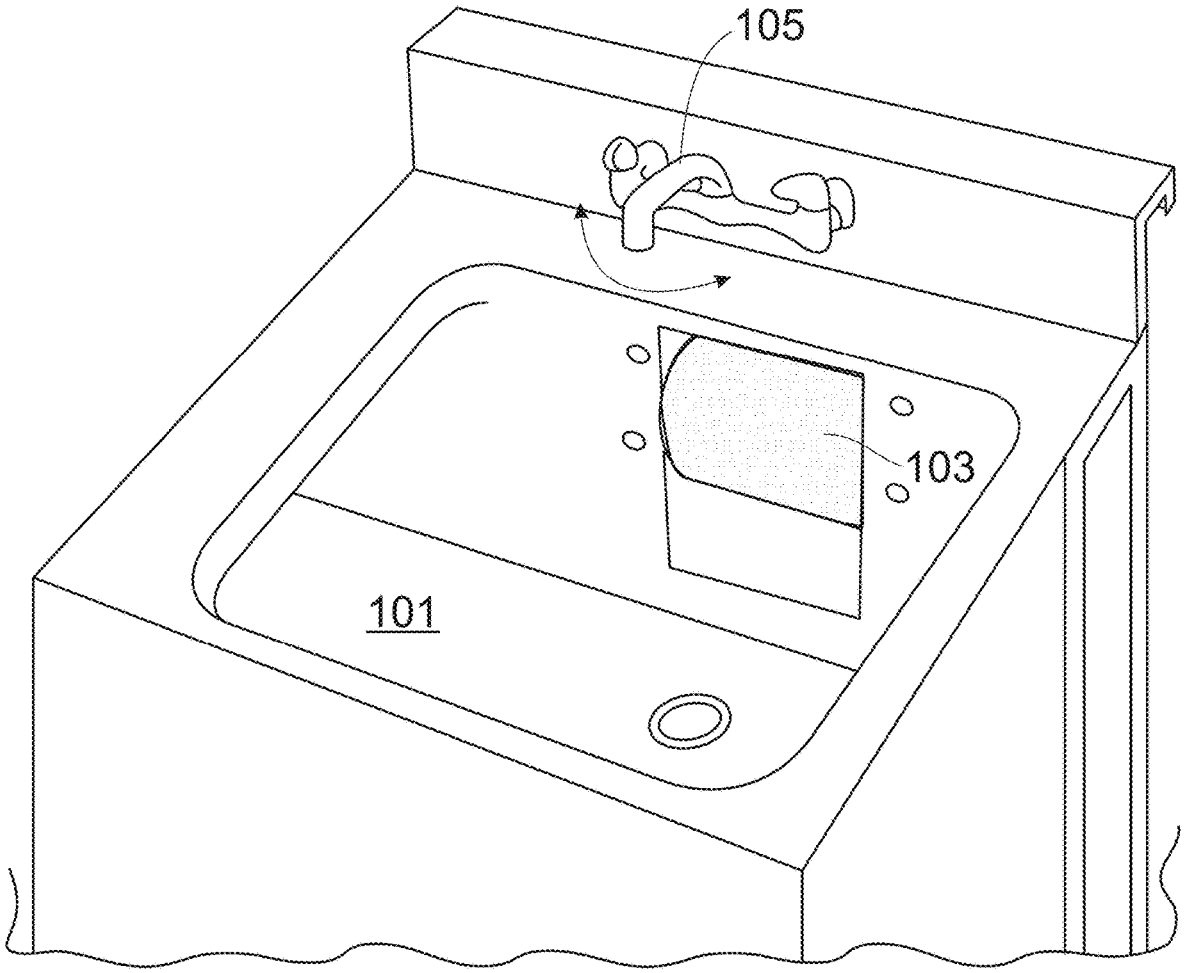
FIG. 8 is a detailed view of the sink showing a centrally positioned swiveling faucet, illustrating how the faucet can be used for normal sink functions and positioned over the cleaning brush wheel when needed, according to an embodiment of the present invention.

Referring now to FIG. 8, in some embodiments, the sink is equipped with a faucet 105 positioned at the center of the sink basin 101, allowing the sink to function as a conventional sink when needed. The faucet 105 is configured to swivel, enabling it to be positioned as necessary. In one position, the faucet 105 directs water into the center of the sink basin, allowing the sink to be used for general washing or rinsing tasks. When needed for cleaning painting equipment, the faucet 105 can be swiveled over the cleaning brush wheel 103, directing water onto the rotating bristles to facilitate paint removal from brushes. This dual-functionality design ensures that the sink remains versatile while integrating the specialized cleaning capabilities required for painting tools. Advantageously, the faucet also improves the ease of use, allowing a user to alternate between different cleaning tasks without obstruction.

As previously discussed, there is a drain 118 in the bottom of the sink basin 101. In one embodiment, the drain 118 connects to a drain hose 119 which is used to direct the paint-water effluent from the sink basin 101 toward an appropriate water treatment process such as a municipal sewer. It should be appreciated that the invention may be adopted or varied depending on the type of paint cleaning needed, however, in the current arrangement, it is intended for non-hazardous paint cleaning, such as water or latex based paints, that may be legally deposited into the municipal sewer.

The sink of the present invention addresses several long-standing problems in the art of cleaning paint brushes and roller covers. First, conventional sinks and cleaning stations lack a dedicated, motor-driven brush wheel integrated into the sink basin itself which forces painters to rely on manual scrubbing or handheld brushes that are both time-consuming and less effective in removing residual paint. By embedding the brush wheel within a niche of the sink basin and driving it with a motor, the present invention significantly reduces manual effort and improves the thoroughness of paint removal. Second, when spinning a roller cover under running water, conventional methods often generate overspray and splatter, creating a mess in the surrounding area. The invention's overhang, integrated as part of the sink body, catches and directs the overspray back into the sink basin for proper drainage, minimizing cleanup and preventing paint-laden water from escaping into unintended areas. Together, these features provide a more efficient, cleaner, and environmentally responsible solution for professional and DIY painters.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated and can be made without departing from the spirit and scope of the invention.

For example, in some embodiments, the sink may include a peg board connected to the body of the sink to enable tools to be hung as well known in the art. Similarly, storage areas, drawers, etc. may be provided.

It should further be noted that throughout the entire disclosure, the labels such as left, right, front, back, top, bottom, forward, reverse, clockwise, counterclockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. An apparatus for cleaning painting equipment comprising:

a sink body containing a sink basin;

an overhang portion of the sink body which serves as a partial ceiling to the sink body, the overhang portion partially extending over at least a portion of the sink basin, wherein the overhang portion is configured to capture and direct overspray back into the sink basin;

a hanger attached to the sink body and located underneath the overhang portion, the hanger dimensioned to support a paint roller so that a paint roller cover portion is positioned within the sink basin and under the overhang portion during cleaning;

a securing element configured to secure the paint roller in place during cleaning; and a drain in the bottom of the sink basin connected to a drain hose;

wherein the overhang portion includes a slit enabling a neck of the paint roller to pass through such that the paint roller is configured to be positioned in a vertical orientation on the hanger:

wherein the securing element is a hinged panel that is configured to close over the slit in the overhang portion to secure the paint roller cover in position during cleaning.

2. An apparatus for cleaning painting equipment, comprising:

a sink body defining a sink basin with a niche formed in a sidewall of the sink basin;

a cleaning brush wheel positioned at least partially in the niche, the brush wheel extending into the sink basin to receive water from a faucet;

a motor mounted on the sink body and operably connected to the cleaning brush wheel via an axle;

an overhang extending over at least a portion of the sink basin, the overhang configured to confine overspray and splatter within the sink basin;

a hanger positioned beneath the overhang to support a paint roller cover in the sink basin and a slit to allow the paint roller cover to be positioned under the overhang during cleaning;

one or more water ports connectable to a water source for supplying water to the faucet; and a drain in the bottom of the sink basin for channeling paint-water effluent away from the sink body:

wherein the overhang further comprises a hinged panel that seals the slit when closed, thereby enclosing the paint roller within the overhang.

3. The apparatus of claim 2, wherein the cleaning brush wheel includes stainless-steel bristles.

4. The apparatus of claim 2, wherein the sink body is constructed of injection-molded plastic.

5. The apparatus of claim 2, wherein the motor is a variable-speed motor configured to rotate the cleaning brush wheel at multiple speeds.

6. The apparatus of claim 2, wherein the one or more water ports include a hot water port and a cold water port.

7. The apparatus of claim 2, wherein the one or more water ports include a port for attaching a hose.

8. The apparatus of claim 2, wherein the sink body is constructed of stainless steel.

9. The apparatus of claim 2, wherein the faucet is centrally positioned within the sink basin and is configured to swivel between: a first position, in which the faucet directs water toward the center of the sink basin for conventional sink use, and a second position, in which the faucet is positioned over the cleaning brush wheel to direct water onto the bristles for cleaning paint brushes.

* * * * *